United States Patent [19]

Bradley

[11] 4,453,706

[45] Jun. 12, 1984

[54] MULTIPLE WEB UNIT HANDLING APPARATUS WITH CUT-OFF ROLLS

[75] Inventor: John J. Bradley, Green Bay, Wis.

[73] Assignee: Paper Converting Machine Company, Green Bay, Wis.

[21] Appl. No.: 477,233

[22] Filed: Mar. 21, 1983

[51] Int. Cl.[3] ..... B65H 39/02

[52] U.S. Cl. ..... 270/54; 270/58

[58] Field of Search ..... 270/52–54, 270/51, 41; 493/435, 440; 198/644

[56] References Cited

U.S. PATENT DOCUMENTS

| | | | |
|---|---|---|---|
| 2,626,074 | 1/1953 | Vogt | 270/54 |
| 2,869,864 | 1/1959 | Burgmer | 270/52 |
| 3,147,969 | 9/1964 | Martin | 270/52 |
| 3,556,510 | 1/1971 | Treff | 270/52 |
| 3,966,186 | 6/1976 | Helm | 270/58 |
| 4,050,686 | 9/1977 | McCain et al. | 270/54 |
| 4,360,194 | 11/1982 | Bradley | 270/54 X |

*Primary Examiner*—E. H. Eickholt

*Attorney, Agent, or Firm*—Tilton, Fallon, Lungmus & Chestnut

[57] ABSTRACT

A web unit handling apparatus wherein a plurality of web units are separately advanced along a plurality of delivery paths which are aligned along a lineal collection path, each web unit being transferred into the collection path and thereafter being advanced therein in synchronism with the other web units being transferred into the path.

3 Claims, 3 Drawing Figures

MULTIPLE WEB UNIT HANDLING APPARATUS WITH CUT-OFF ROLLS

BACKGROUND AND SUMMARY OF INVENTION

This invention relates to web unit handling apparatus and, more particularly, to an apparatus which presents web units in convenient substacks for rapid and reliable accumulation into larger stacks.

My prior U.S. Pat. No. 4,360,194 dealt specifically with transverse folded products such as tissues and paper napkins. This application deals with products such as cling-free sheets which are not folded and with towels such as C-fold towels which are only longitudinally folded.

Apparatus is available for the manufacturing of web products which are not transverse folded and which are not subject to the severe speed limitations described in the above U.S. Pat. No. 4,360,194. However, in frequent instances, such unfolded web products are subject to adhesion when compacted incident to transverse severing and in such cases, severe speed limitations do apply. No apparatus is currently available which avoids the twin difficulties of compaction adhesion on the one hand and speed limitations on the other.

These difficulties and limitations have been avoided through the practice of the invention which involves separately advancing a plurality of web units along the same plurality of delivery paths, the delivery paths being aligned along a linear collection path. Thereafter, the web units are transferred into the collection path and advanced thereon in synchronism with other web units being transferred to the collection path to deliver a series of substacks which are then accumulated into the desired stack or "count".

Other objects and advantages of the invention can be seen in the details of the ensuing detailed description.

DETAILED DESCRIPTION

Figure 1:
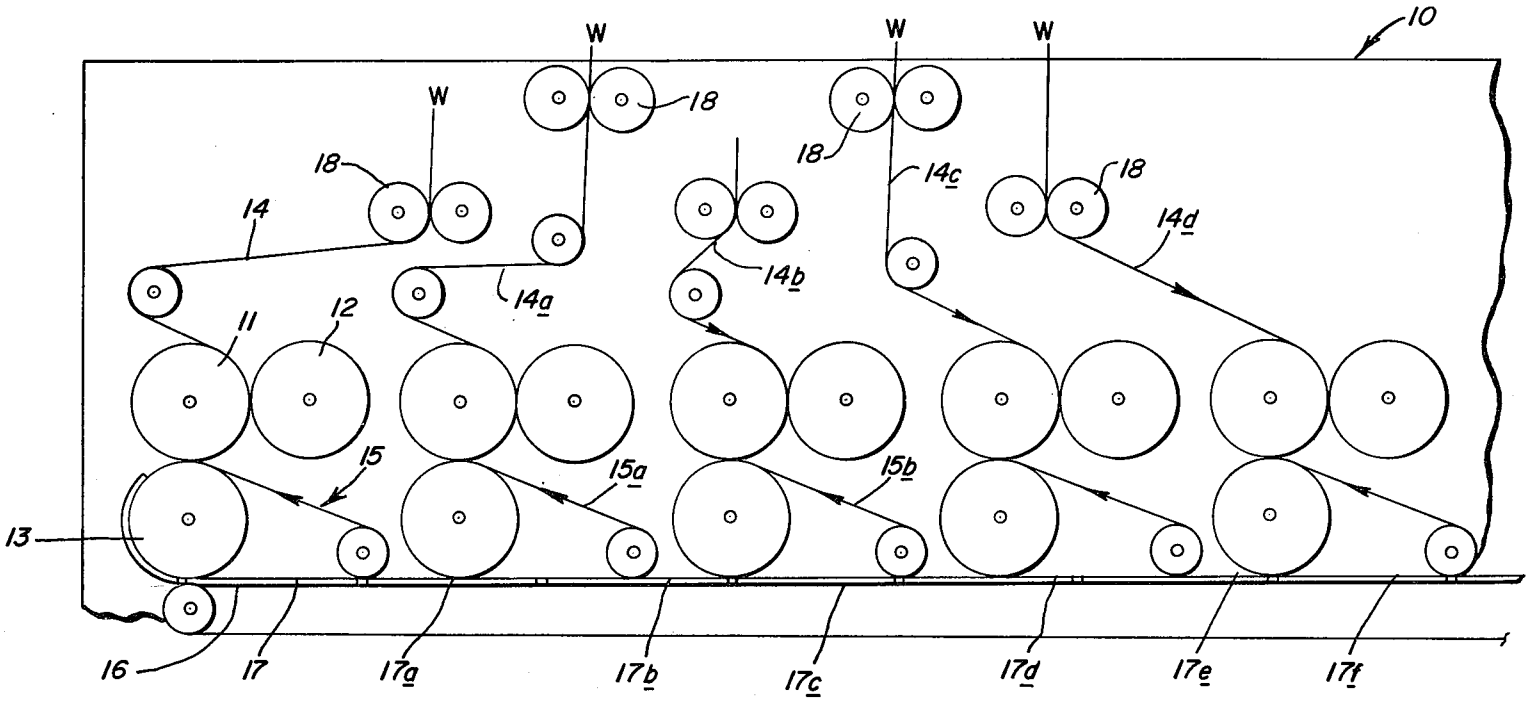
Figure 3:
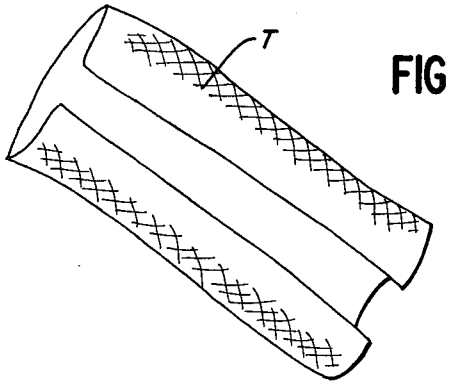
Figure 2:
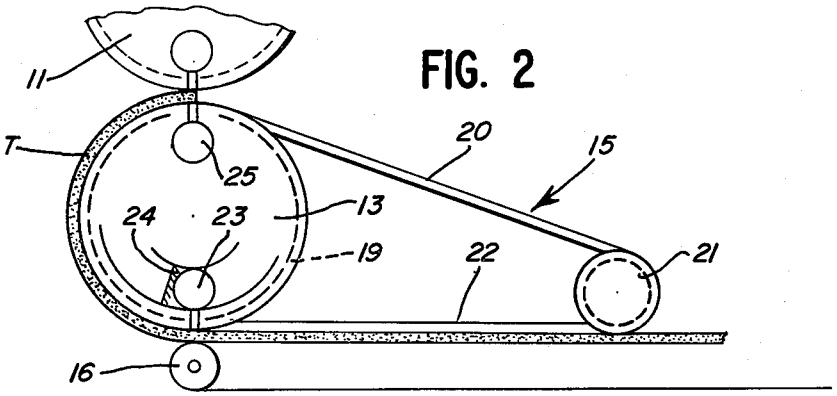

The invention is described in conjunction with an illustrative embodiment in the accompanying drawing, in which FIG. 1 is a fragmentary side elevational view of apparatus employed in the practice of the invention;

FIG. 2 is an enlarged, fragmentary side elevational view of a transfer device similar to that of FIG. 1 but operating on C-folded towels; and FIG. 3 is a schematic representation of a C-folded towel.

In the illustration given and with reference first to FIG. 1, the numeral 10 designates generally the frame of the machine which is seen only in fragmentary form. The frame 10 supports a plurality of sets of rolls, the most left hand set including a carrier roll 11, a cutoff roll 12 and a transfer roll 13. These rolls 11–13 define in part a delivery path 14 for a web W which is converted into sequential web units and transferred by means of a transfer mechanism generally designated 15 to a collection conveyor 16.

The collection conveyor 16 advances each web unit 17 in synchronism with the speed of the web units being delivered along the various delivery paths 14, **14*a*, 14*b*, etc. If, for example, the webs W are being processed to provide 600 units per minute, i.e., ten per second, the conveyor 16 in the collection path advances each substack or unit 17, 17*a*, 17*b*, etc., one repeat length in 1/10 second so as to position a substack 17, 17*a*, etc. under the transfer mechanism 15, 15*a*, 15*b*, etc., at the time the web unit being delivered by that mechanism is deposited—so that the sub-stack 17*f* (at the right hand side of FIG. 1) is five units high. The transfer mechanisms are arranged to provide a slight spacing between adjacent substacks—about $\frac{1}{8}$ to $\frac{1}{4}$". This is achieved by rotating the rolls 11–13 at a speed slightly higher than the speed of the web entering the delivery paths 14, 14*a*, etc. For example, the surface speed of the pull rolls 18 is slightly less than the surface speed of the rolls 11–13**.

The various webs W can be derived from a larger width parent roll (not shown) and advanced through a slitter (also not shown) where the webs W are developed. In the illustration given, the multi-width web is slit into five individual webs with three of the webs passing through the lower pull rolls 18 while the upper two webs pass through the alternate higher pull rolls 18. Optionally, these webs prior to entering the pull roll nips can be C-folded in the fashion illustrated in FIG. 3. Suitable folding boards for this purpose can be seen in my co-pending application Ser. No. 77,298, filed Sept. 20, 1979.

As in U.S. Pat. No. 4,360,194, the rolls 11–13 are cantilever mounted for ready access. The carrier and cutoff rolls 11 and 12 are arranged to transversely sever the web W into discrete lengths afterwhich the vacuum actuated carrier and transfer rolls 11, 13 transfer the web units to the conveyor 16 as seen in FIG. 2.

The transfer roll 13 (see FIG. 2) is circumferentially grooved as at 19 to accommodate belts 20 constituting part of the transfer mechanism 15. Thus, as the severed web unit is brought around the transfer roll 13, the belts 20 (along with the termination of the vacuum) cause the units to be stripped from the transfer roll 13 and applied to the conveyor 16 where the units are advanced. The belts 20 besides being entrained on the transfer rolls 13 are also entrained about an idler roll 21 so as to develop a belt run as at 22 which is generally parallel to the collection conveyor 16. In the instance of sizable thickness web units, the belt run 20 may be sloped as by adjusting the location of the idler rolls 21. Alternatively, the collection conveyor 16 can be sloped slightly to compensate for unit built-up.

An advantageous features of the invention is involved in the delivery system. Since the transfer roll 13, the belts 20, and the collection conveyor 16 are all running at exactly the same speed, the relative velocity between the web product and the collection conveyor is zero. This means that there is no deceleration and stopping of the product involved and no acceleration in the transverse direction. For this reason, the invention makes possible the production of uniform stacks at high speed.

In FIG. 3, a C-folded web product such as a towel is seen. This is produced on apparatus similar to that of FIG. 1 but with the addition of folding boards prior to the pull rolls 18.

In FIG. 2, the towel T is in the process of being laid down on a previously developed partial stack of units. The leading vacuum port 23 has just been "blanked" (as at 24) to disconnect it from the vacuum source and thereby release the forward edge of the unit T. Second vacuum port (25) should be directly (180°) opposite port (23). Purpose of 25 is to hold leading edge of next towel, *not* to hold trailing end of towel. First towel is carried forward on 16 via nip between 13 and 16 and between 22 and 16 after port (23) releases towel/-product.

While in the foregoing specification a detailed description of an embodiment of the invention has been set down for the purpose of explanation, many variations in the details hereingiven may be made by those skilled in the art without departing from the spirit and scope thereof.

I claim:

1. Apparatus for producing stacks of web units comprising a frame, a collection conveyor horizontally disposed on said frame, means operably associated with said collection conveyor for moving the same at a predetermined speed, a plurality of cutoff transfer devices successively aligned along said collection conveyor terminating in a discharge end, each said cutoff-transfer device including a transfer roll having an outer surface, means associated with said transfer rolls for rotating the same to move said surface at said predetermined speed, means for separately, advancing at slightly less than said predetermined speed a plurality of continuous webs, one into each of said cutoff-transfer devices, said cutoff-transfer devices providing individual web units, means for controlledly transferring said individual web units from each of said cutoff-transfer devices to a series of points on said collection conveyor for advancing units thereon in synchronism with the units being delivered successively thereto to develop a series of stacks, each stack having a plurality of units therein, said transferring means including belt means for traveling on said transfer roll in underlying relation to a web unit on said transfer roll whereby said belt means travels at said predetermined speed, each said belt means being entrained about an idler roll spaced downstream relative to the path of collection conveyor movement from said transfer roll to provide a length of travel generally parallel to said collection conveyor to confine each individual web unit as the same is superposed onto a previously transferred individual web unit, said surface of each of said transfer rolls, each said belt means and said collection conveyor all being arranged so that at the point of transfer of an individual web unit all of said transfer roll surface, belt means, individual unit and collection conveyor are traveling at the same speed and in the same direction whereby an individual web unit traveling with said transfer roll changes direction progressively during transfer without any substantial change in speed.

2. The apparatus of claim 1 in which an accumulator is provided at the end of said collection path for accumulating a number of said stacks into a larger stack.

3. The apparatus of claim 1 in which said cutoff-transfer device includes a vacuum port-equipped transfer roll, said transferring means including belt means for traveling on said transfer roll in underlying relation to a web unit on said transfer roll.

* * * * *